US007815995B2

(12) United States Patent
Clark et al.

(10) Patent No.: US 7,815,995 B2
(45) Date of Patent: Oct. 19, 2010

(54) TEXTURED FABRICS APPLIED WITH A TREATMENT COMPOSITION

(75) Inventors: James W. Clark, Roswell, GA (US); Ming Xie, Marietta, GA (US); James J. Detamore, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 670 days.

(21) Appl. No.: 10/378,282

(22) Filed: Mar. 3, 2003

(65) Prior Publication Data

US 2004/0175556 A1 Sep. 9, 2004

(51) Int. Cl.
*B31F 1/12* (2006.01)
*B32B 5/00* (2006.01)

(52) U.S. Cl. ..... 428/152; 428/153; 442/59; 442/152; 442/153; 442/154

(58) Field of Classification Search ..... 442/59, 442/152, 153, 154; 428/152, 153
See application file for complete search history.

(56) References Cited

U.S. PATENT DOCUMENTS 3,260,778 A 7/1966 Walton
3,261,796 A 7/1966 Simms
3,338,992 A 8/1967 Kinney
3,341,394 A 9/1967 Kinney
3,424,643 A * 1/1969 Lewis Jr., et. al. ..... 428/109
3,485,706 A 12/1969 Evans
3,502,538 A 3/1970 Petersen
3,502,763 A 3/1970 Hartmann
3,542,615 A 11/1970 Dobo et al.
3,574,229 A 4/1971 Pizzarello et al.
3,577,554 A 5/1971 Parrish et al.
3,692,618 A 9/1972 Dorschner et al.
3,714,099 A 1/1973 Biale
3,714,100 A 1/1973 Biaele et al.
3,753,941 A 8/1973 Teumac et al.

(Continued)

FOREIGN PATENT DOCUMENTS

EP 0062338 A1 10/1982

(Continued)

OTHER PUBLICATIONS

Complete Textile Glossary, 2001, Celanese Acetate, LLC.*

(Continued)

*Primary Examiner*—D. Lawrence Tarazano
*Assistant Examiner*—Matthew D Matzek
(74) *Attorney, Agent, or Firm*—Dority & Manning, P.A.

(57) ABSTRACT

A textured fabric having at least one surface that contains peaks and valleys is provided. Greater than about 90% of the peaks and less than about 10% of the valleys are disposed with a treatment composition, the treatment composition comprising a latex polymer. In one embodiment, for example, the textured fabric is a hydraulically entangled composite fabric formed from a spunbond nonwoven web and pulp fibers. When coated onto the fabric, the treatment composition may form a thin film layer on the fiber surface that prevents fibers or zones of fibers from breaking away from the surface as lint. Further, because the coating is applied only to the peaks, the valleys may remain free of the latex polymer and substantially maintain the absorbency of the uncoated fabric.

29 Claims, 5 Drawing Sheets

U.S. PATENT DOCUMENTS 3,765,974 A * 10/1973 Petersik et al. ..... 156/84
3,802,817 A 4/1974 Matsuki et al.
3,849,241 A 11/1974 Butin et al.
3,855,046 A 12/1974 Hansen et al.
3,867,225 A * 2/1975 Nystrand ..... 156/209
3,879,257 A 4/1975 Gentile et al.
4,041,203 A 8/1977 Brock et al.
4,134,948 A * 1/1979 Baker, Jr. ..... 264/518
4,199,400 A 4/1980 Bakule et al.
4,288,499 A 9/1981 Kielbania, Jr.
4,340,563 A 7/1982 Appel et al.
4,374,888 A 2/1983 Bornslaeger
4,424,240 A 1/1984 Kielbania, Jr.
4,457,980 A 7/1984 Daniels et al.
4,507,342 A 3/1985 Kielbania, Jr.
4,529,480 A 7/1985 Trokhan
4,544,697 A 10/1985 Pickelman et al.
4,582,663 A 4/1986 Pickelman et al.
D287,195 S 12/1986 Billgren
D287,433 S 12/1986 Ellers
4,655,760 A 4/1987 Morman et al.
4,657,802 A 4/1987 Morman
4,663,220 A 5/1987 Wisneski et al.
4,720,415 A 1/1988 Vander Wielen et al.
4,740,536 A 4/1988 Chao
4,748,167 A 5/1988 Das et al.
4,766,029 A 8/1988 Brock et al.
4,781,966 A 11/1988 Taylor
4,789,699 A 12/1988 Kieffer et al.
4,879,170 A 11/1989 Radwanski et al.
4,902,564 A 2/1990 Israel et al.
4,918,877 A 4/1990 Dutka
4,965,122 A 10/1990 Morman
4,981,747 A 1/1991 Morman
5,048,589 A 9/1991 Cook et al.
5,085,514 A 2/1992 Mallik et al.
5,087,646 A 2/1992 Tork et al.
5,102,606 A 4/1992 Ake et al.
5,108,820 A 4/1992 Kaneko et al.
5,108,827 A 4/1992 Gessner
5,114,781 A 5/1992 Morman
5,116,662 A 5/1992 Morman
5,151,320 A 9/1992 Homonoff et al.
5,166,254 A 11/1992 Nickle et al.
5,169,706 A 12/1992 Collier, IV et al.
5,169,888 A 12/1992 Sales
5,198,492 A 3/1993 Stack
5,204,703 A 4/1993 Hutchinson et al.
5,213,881 A 5/1993 Timmons et al.
5,226,992 A 7/1993 Morman
D341,944 S 12/1993 Peter
5,284,703 A 2/1994 Everhart et al.
5,336,545 A 8/1994 Morman
5,336,552 A 8/1994 Strack et al.
5,370,132 A 12/1994 Weber et al.
5,382,400 A 1/1995 Pike et al.
5,385,775 A 1/1995 Wright
5,389,723 A 2/1995 Iqbal et al.
5,399,412 A 3/1995 Sudall et al.
D363,611 S 10/1995 Nakamura
5,459,912 A 10/1995 Oathout
5,464,688 A 11/1995 Timmons et al.
5,492,598 A 2/1996 Hermans et al.
5,498,232 A 3/1996 Scholz
5,510,001 A 4/1996 Hermans et al.
5,536,552 A 7/1996 Scripsick
5,591,309 A 1/1997 Rugowski et al.
5,620,779 A 4/1997 Levy et al.
5,645,916 A 7/1997 Oathout
D390,708 S 2/1998 Brown
5,840,403 A 11/1998 Trokhan et al.
5,849,833 A 12/1998 Puschak et al.
5,853,859 A 12/1998 Levy et al.
5,922,406 A 7/1999 Ludford, III
5,962,112 A 10/1999 Haynes et al.
5,972,039 A 10/1999 Honeycutt et al.
5,990,226 A 11/1999 Arita et al.
5,998,543 A 12/1999 Collins et al.
6,001,913 A 12/1999 Thames et al.
6,017,417 A 1/2000 Wendt et al.
D419,781 S 2/2000 Pratt et al.
6,020,397 A 2/2000 Matzinger
6,022,818 A 2/2000 Welchel et al.
6,060,556 A 5/2000 Collins et al.
D428,267 S 7/2000 Romano, III et al.
6,084,023 A 7/2000 Rasoul et al.
6,093,665 A 7/2000 Sayovitz et al.
6,096,412 A 8/2000 McFarland et al.
6,103,061 A * 8/2000 Anderson et al. ..... 162/108
6,120,640 A 9/2000 Shih et al.
D434,913 S 12/2000 Schmidt et al.
6,174,948 B1 1/2001 Thames et al.
6,187,140 B1 2/2001 Anderson et al.
6,197,404 B1 3/2001 Varona
6,200,669 B1 3/2001 Marmon et al.
6,203,720 B1 3/2001 Thames et al.
6,214,146 B1 4/2001 Merker
D446,986 S 8/2001 McCumber, Jr.
6,299,729 B1 10/2001 Heath et al.
6,313,049 B1 11/2001 Heady et al.
6,315,864 B2 11/2001 Anderson et al.
6,340,663 B1 1/2002 Deleo et al.
D454,433 S 3/2002 Peter
6,381,817 B1 5/2002 Moody, III
6,498,202 B1 12/2002 Sun et al.
6,500,289 B2 12/2002 Merker et al.
6,502,288 B2 1/2003 Black et al.
2003/0116259 A1 * 6/2003 Sayovitz et al. ..... 156/183
2003/0118782 A1 * 6/2003 Graff ..... 428/172

FOREIGN PATENT DOCUMENTS

EP 0105598 A2 4/1984
EP 0128667 A2 12/1984
EP 0373974 A2 6/1990
EP 1059378 A1 12/2000
EP 1121947 A1 8/2001
EP 1236827 A1 9/2002
EP 1266957 A1 12/2002
WO WO 8905114 A1 6/1989
WO WO 0053406 A1 9/2000
WO WO 0147403 A1 7/2001
WO WO 0188247 A1 11/2001
WO WO 02/40628 A2 5/2002
WO WO 0243536 A2 6/2002
WO WO 02051644 A1 7/2002
WO WO 02/100233 A1 12/2002

OTHER PUBLICATIONS

Abstract of EP 0 377 434 A2, Jul. 11, 1990.
Abstract of Japanese Patent No. 61-55274, Mar. 19, 1986.
Abstract of Japanese Patent No. 6212081, Nov. 23, 1999.
Abstract of Japanese Patent No. 62231787, Oct. 12, 1987.
Abstract of Japanese Patent No. 63256651, Oct. 24, 1988.
Article—*Polymer Blends and Composites*, J.A. Manson, et al., copr. 1976, pp. 273-277.
PCT Search Report for PCT/US2004/004062 and Written Opinion, Aug. 11, 2004.

* cited by examiner

TEXTURED FABRICS APPLIED WITH A TREATMENT COMPOSITION

BACKGROUND OF THE INVENTION

Wipers and other products are often printed with certain chemicals to form logos, hide food stains, etc. Unfortunately, however, the harsh environments to which these products are exposed may cause the printed chemicals to be removed after only a short period of time. For example, wipers in the food service industry are often used with harsh cleaners, such as bleach (e.g., sodium hypochlorite), acid-based soaps, or commercial mixtures, e.g., The Clorox Company's Formula 409® "all purpose" cleaner, which contains water, detergents, and the grease cutter 2-butoxyethanol (an alcohol). Cleaning solutions also often contain sanitizing chemicals, which may readily remove the treatment from a printed substrate.

In response to this problem, treatment compositions were developed that remain on the fabric when exposed to common chemical cleaning chemicals. For instance, U.S. Pat. No. 5,853,859 to Levy, et al., which is assigned to Kimberly-Clark Worldwide, Inc., describes a treatment composition that comprises a room temperature curable latex polymer, a pigment, and a cure promoter. The treatment composition may be "pattern printed" onto a high pulp nonwoven composite using printing techniques, such as flexographic printing, gravure printing, screen printing, or ink jet printing. When pattern printed onto a substrate and dried, the fabric retains a colorfastness above 3 when exposed to liquids with a pH from about 2 to about 13.

Despite the advances attained, however, a need for improvement nevertheless remains. For instance, "pattern printing" of fabrics with such compositions may sometimes result in the production of lint, which is defined as individual airborne fibers and fiber fragments. Specifically, much of the user-contacting surface of the printed fabrics remain uncoated with the treatment. Accordingly, fibers and fiber fragments may be easily removed during use. Unfortunately, however, previous efforts to reduce lint by coating the entire surface have proven problematic because the absorbency of the fabric is adversely affected.

As such, a need currently exists for a fabric that has low lint and maintains good absorbency, and yet retains the desired colorfastness when applied with a treatment composition.

SUMMARY OF THE INVENTION

In accordance with one embodiment of the present invention, a textured fabric that comprises a nonwoven web is disclosed. If desired, the textured fabric may be a nonwoven laminate or a composite, such as a composite of a nonwoven web hydraulically entangled with a fibrous component (e.g., cellulosic fibers). The fibrous component may comprise greater than about 50% by weight of the textured fabric, and in some embodiments, from about 60% to about 90% by weight of the textured fabric. In one embodiment, at least a portion of the textured fabric is creped (e.g., wet and/or dry creped).

Regardless of the construction of the textured fabric, at least one surface of the fabric contains peaks and valleys, wherein greater than about 90% of the peaks and less than about 10% of the valleys are disposed with a treatment composition. In some embodiments, approximately 100% of the peaks are disposed with the treatment composition, and in some embodiments, approximately 0% of the valleys are disposed with the treatment composition. The treatment composition comprises a latex polymer and optionally other components, such as a cure promoter, a pigment, water, etc. The latex polymer may be selected from the group consisting of ethylene vinyl acetates, ethylene vinyl chlorides, styrene-butadiene, acrylates and styrene-acrylate copolymers. The solids add-on level of the treatment composition may be from about 0.1% to about 20%, and in some embodiments, from about 0.5% to about 5%.

In accordance with another embodiment of the present invention, a method is disclosed for forming a product that generates relatively low levels of lint. The method comprises:

- providing a nonwoven web;
- hydraulically entangling the nonwoven web with a fibrous component to form a fabric, wherein the fibrous component comprises greater than about 50% by weight of the fabric;
- adhering the fabric to a creping surface and creping the fabric therefrom, wherein the creped fabric has peaks and valleys; and
- coating the fabric with a treatment composition that comprises a crosslinkable latex polymer so that greater than about 90% of the peaks and less than about 10% of the valleys contain the treatment composition.

In some embodiments, the fabric is supported by a patterned surface during creping. Further, the fabric may be pressed into engagement with the creping surface at a pressure of from about 50 to about 350 pounds per linear inch (pli), and in some embodiments, at a pressure of from about 150 to about 250 pli. A creping adhesive may also be used to facilitate the adherence of the fabric to the creping surface.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
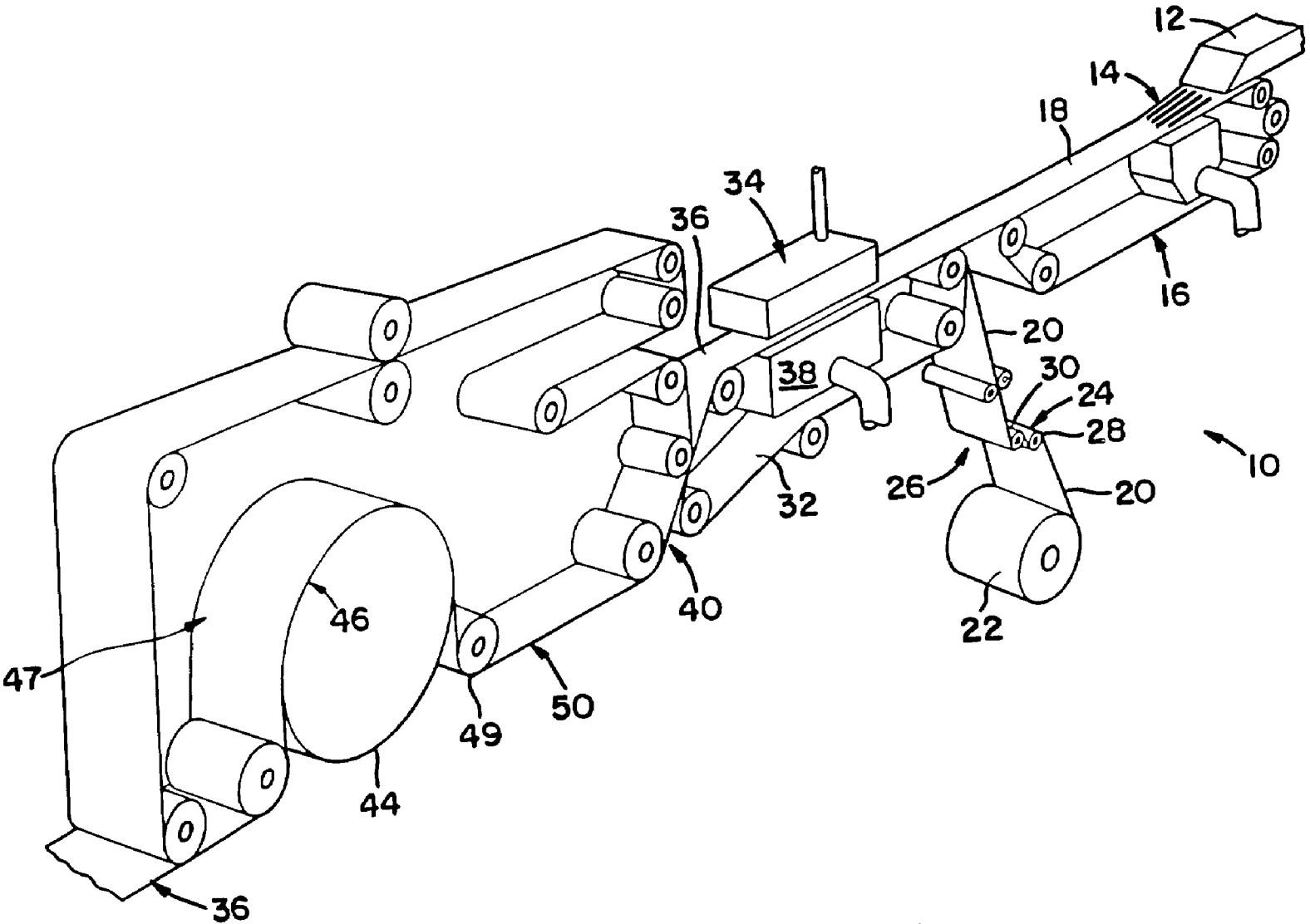
FIG. 1 is a schematic illustration of a process for forming a hydraulically entangled fabric in accordance with one embodiment of the present invention.

Repeat use of reference characters in the present specification and drawings is intended to represent same or analogous features or elements of the invention.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention.

For instance, features illustrated or described as part of one embodiment, may be used on another embodiment to yield a still further embodiment. Thus, it is intended that the present invention covers such modifications and variations as come within the scope of the appended claims and their equivalents.

Definitions

As used herein, the term "nonwoven web" refers to a web having a structure of individual fibers or threads that are interlaid, but not in an identifiable manner as in a knitted fabric. Nonwoven webs include, for example, meltblown webs, spunbond webs, carded webs, etc.

As used herein, the term "spunbond web" refers to a nonwoven web formed from small diameter substantially continuous fibers. The fibers are formed by extruding a molten thermoplastic material as filaments from a plurality of fine, usually circular, capillaries of a spinnerette with the diameter of the extruded fibers then being rapidly reduced as by, for example, eductive drawing and/or other well-known spunbonding mechanisms. The production of spunbond webs is described and illustrated, for example, in U.S. Pat. No. 4,340,563 to Appel, et al., U.S. Pat. No. 3,692,618 to Dorschner, et al., U.S. Pat. No. 3,802,817 to Matsuki, et al., U.S. Pat. No. 3,338,992 to Kinney, U.S. Pat. No. 3,341,394 to Kinney, U.S. Pat. No. 3,502,763 to Hartman, U.S. Pat. No. 3,502,538 to Levy, U.S. Pat. No. 3,542,615 to Dobo, et al., and U.S. Pat. No. 5,382,400 to Pike, et al., which are incorporated herein in their entirety by reference thereto for all purposes. Spunbond fibers are not tacky when they are deposited onto a collecting surface. Spunbond fibers may sometimes have diameters less than about 40 microns, and are often from about 5 to about 20 microns.

As used herein, the term "meltblown web" refers to a nonwoven web formed from fibers extruded through a plurality of fine, usually circular, die capillaries as molten fibers into converging high velocity gas (e.g. air) streams that attenuate the fibers of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin, et al., which is incorporated herein in its entirety by reference thereto for all purposes. In some instances, meltblown fibers may be microfibers that may be continuous or discontinuous, are generally smaller than 10 microns in diameter, and are tacky when deposited onto a collecting surface.

As used herein, the term "pulp" refers to fibers from natural sources such as woody and non-woody plants. Woody plants include, for example, deciduous and coniferous trees. Non-woody plants include, for example, cotton, flax, esparto grass, milkweed, straw, jute, hemp, and bagasse.

As used herein, the term "low-average fiber length pulp" refers to pulp that contains a significant amount of short fibers and non-fiber particles. Many secondary wood fiber pulps may be considered low average fiber length pulps; however, the quality of the secondary wood fiber pulp will depend on the quality of the recycled fibers and the type and amount of previous processing. Low-average fiber length pulps may have an average fiber length of less than about 1.2 mm as determined by an optical fiber analyzer such as, for example, a Kajaani fiber analyzer model No. FS-100 (Kajaani Oy Electronics, Kajaani, Finland). For example, low average fiber length pulps may have an average fiber length ranging from about 0.7 to 1.2 mm. Exemplary low average fiber length pulps include virgin hardwood pulp, and secondary fiber pulp from sources such as, for example, office waste, newsprint, and paperboard scrap.

As used herein, the term "high-average fiber length pulp" refers to pulp that contains a relatively small amount of short fibers and non-fiber particles. High-average fiber length pulp may be formed from certain non-secondary (i.e., virgin) fibers. Secondary fiber pulp that has been screened may also have a high-average fiber length. High-average fiber length pulps may have an average fiber length of greater than about 1.5 mm as determined by an optical fiber analyzer such as, for example, a Kajaani fiber analyzer model No. FS-100 (Kajaani Oy Electronics, Kajaani, Finland). For example, a high-average fiber length pulp may have an average fiber length from about 1.5 mm to about 6 mm. Exemplary high-average fiber length pulps that are wood fiber pulps include, for example, bleached and unbleached virgin softwood fiber pulps.

DETAILED DESCRIPTION

The present invention is directed to a textured fabric having "peaks" and "valleys", or raised and depressed regions. In one embodiment, for example, the textured fabric is a hydraulically entangled composite fabric formed from a spunbond nonwoven web and pulp fibers. The peaks of the textured fabric are coated with a treatment composition to provide the fabric with various beneficial properties. For example, the treatment composition may contain a latex polymer that, when coated onto the fabric, forms a thin film layer on the fiber surface that prevents fibers or zones of fibers from breaking away from the surface as lint. Further, because the coating is applied only to the peaks, the valleys may remain free of the latex polymer and substantially maintain the absorbency of the uncoated fabric.

A. Textured Fabrics

The textured fabric contains at least one nonwoven web. Examples of nonwoven webs (apertured or non-apertured) include, but are not limited to, spunbonded webs, meltblown webs, bonded carded webs, air-laid webs, coform webs, hydraulically entangled webs, and so forth. The nonwoven web may be formed by a variety of different materials. For instance, some examples of suitable polymers that may be used to form the nonwoven web include, but are not limited to, polyolefins, polyesters, polyamides, as well as other melt-spinnable and/or fiber forming polymers. The polyamides that may be used in the practice of this invention may be any polyamide known to those skilled in the art including copolymers and mixtures thereof. Examples of polyamides and their methods of synthesis may be found in "Polyamide Resins" by Don E. Floyd (Library of Congress Catalog number 66-20811, Reinhold Publishing, NY, 1966). Particularly commercially useful polyamides are nylon-6, nylon 66, nylon-11 and nylon-12. These polyamides are available from a number of sources, such as Emser Industries of Sumter, S.C. (GRILON & GRILAMID nylons) and Atochem, Inc. Polymers Division, of Glen Rock, N.J. (RILSAN nylons), among others. Many polyolefins are available for fiber production, for example, polyethylenes such as Dow Chemical's ASPUN 6811A LLDPE (linear low density polyethylene), 2553 LLDPE and 25355 and 12350 high density polyethylene are such suitable polymers. Fiber forming polypropylenes include Exxon Chemical Company's ESCORENE PD 3445 polypropylene and Himont Chemical Co.'s PF-304. Numerous other suitable fiber forming polyolefins, in addition to those listed above, are also commercially available.

The materials used to form the nonwoven web may be in the form of continuous fibers, staple fibers, and so forth.

Continuous fibers, for example, may be produced by known nonwoven extrusion processes, such as, for example, known solvent spinning or melt-spinning processes. In one embodiment, the nonwoven web contains continuous melt-spun fibers formed by a spunbond process. The spunbond fibers may be formed from any melt-spinnable polymer, co-polymers or blends thereof. The denier of the fibers used to form the nonwoven web may also vary. For instance, in one particular embodiment, the denier of polyolefin fibers used to form the nonwoven web is less than about 6, in some embodiments less than about 3, and in some embodiments, from about 1 to about 3.

Although not required, some or all of the fibers used to form the nonwoven web may also be bonded to improve the durability, strength, hand, and/or other properties of the web. For instance, the nonwoven web may be thermally, ultrasonically, adhesively and/or mechanically bonded. As an example, the nonwoven web may be point bonded such that it possesses numerous small, discrete bond points. An exemplary point bonding process is thermal point bonding, which involves passing one or more layers between heated rolls, such as an engraved patterned roll and a second bonding roll. The engraved roll is patterned in some way so that the web is not bonded over its entire surface, and the second roll may be smooth or patterned. As a result, various patterns for engraved rolls have been developed for functional as well as aesthetic reasons. Exemplary bond patterns include, but are not limited to, those described in U.S. Pat. No. 3,855,046 to Hansen, et al., U.S. Pat. No. 5,620,779 to Levy, et al., U.S. Pat. No. 5,962,112 to Haynes, et al., U.S. Pat. No. 6,093,665 to Sayovitz, et al., U.S. Design Pat. No. 428,267 to Romano, et al. and U.S. Design Pat. No. 390,708 to Brown, which are incorporated herein in their entirety by reference thereto for all purposes.

If desired, the total bond area and bond density may be selected to optimize the texture of the resulting fabric. Specifically, for a given total bond area, smaller bond densities normally translate into larger bond points, which may enhance the texture of the web but reduce strength. Likewise, larger bond densities normally translate into smaller bond points, which may enhance the strength of the web but reduce texture. To balance these factors, the total bond area may be, for instance, less than about 30% (as determined by conventional optical microscopic methods), while the bond density may be greater than about 100 bonds per square inch. In some embodiments, the nonwoven web may have a total bond area from about 2% to about 30% and/or a bond density from about 250 to about 500 pin bonds per square inch. Such a combination of total bond area and/or bond density may, in some embodiments, be achieved by bonding the nonwoven web with a pin bond pattern having more than about 100 pin bonds per square inch that provides a total bond surface area less than about 30% when fully contacting a smooth anvil roll. In some embodiments, the bond pattern may have a pin bond density from about 250 to about 350 pin bonds per square inch and/or a total bond surface area from about 10% to about 25% when contacting a smooth anvil roll.

Further, the nonwoven web may also be bonded by continuous seams or patterns. As additional examples, the nonwoven web may be bonded along the periphery of the sheet or simply across the width or cross-direction (CD) of the web adjacent the edges. Other bond techniques, such as a combination of thermal bonding and latex impregnation, may also be used. Alternatively and/or additionally, a resin, latex or adhesive may be applied to the nonwoven web by, for example, spraying or printing, and dried to provide the desired bonding. Still other suitable bonding techniques may be described in U.S. Pat. No. 5,284,703 to Everhart, et al., U.S. Pat. No. 6,103,061 to Anderson, et al., and U.S. Pat. No. 6,197,404 to Varona, which are incorporated herein in their entirety by reference thereto for all purposes.

In some embodiments, the nonwoven web may also be combined with other materials and/or layers to form the textured fabric. For example, the nonwoven web may be combined with other nonwoven web layers to form a multi-layered nonwoven laminate. Suitable laminate materials may include, for instance, spunbond/meltblown/spunbond (SMS) laminates and spunbond/meltblown (SM) laminates. An SMS laminate may be made by sequentially depositing onto a moving forming belt a spunbond web layer, a meltblown web layer, and another spunbond layer, and thereafter bonding the laminate. Alternatively, the web layers may be made individually, collected in rolls, and combined in a separate bonding step. Such laminates usually have a basis weight of from about 0.1 to 12 ounces per square yard (osy), in some embodiments, from about 0.5 to about 3 osy, and in some embodiments, from about 0.5 to about 1.5 osy. For instance, the meltblown layer of the SMS laminate may have a basis weight of less than about 0.3 osy, in some embodiments less than about 0.2 osy, and in some embodiments, from about 0.1 osy to about 0.15 osy. Various examples of suitable SMS laminates are described in U.S. Pat. No. 4,041,203 to Brock et al.; U.S. Pat. No. 5,213,881 to Timmons, et al.; U.S. Pat. No. 5,464,688 to Timmons, et al.; U.S. Pat. No. 4,374,888 to Bornslaeger; U.S. Pat. No. 5,169,706 to Collier et al.; and U.S. Pat. No. 4,766,029 to Brock et al., which are incorporated herein in their entirety by reference thereto for all purposes. In addition, commercially available SMS laminates may be obtained from Kimberly-Clark Corporation under the designations Spunguard® and Evolution®.

In addition, elastic laminates may also be utilized. An elastic laminate may contain layers that are bonded together so that at least one of the layers has the characteristics of an elastic polymer. The elastic material used in the elastic laminates may be made from materials that are formed into films, such as a microporous film; fibrous webs, such as a web made from meltblown fibers or spunbond fibers; foams; and so forth. For example, in one embodiment, the elastic laminate may be a "neck-bonded" laminate. A "neck-bonded" laminate refers to a composite material having at least two layers in which one layer is a necked, non-elastic layer and the other layer is an elastic layer. The resulting laminate is thereby a material that is elastic in the cross-direction. Some examples of neck-bonded laminates are described in U.S. Pat. Nos. 5,226,992, 4,981,747, 4,965,122, and 5,336,545, all to Morman, all of which are incorporated herein in their entirety by reference thereto for all purposes.

The elastic laminate may also be a "stretch-bonded" laminate, which refers to a composite material having at least two layers in which one layer is a gatherable layer and in which the other layer is an elastic layer. The layers are joined together when the elastic layer is in an extended condition so that upon relaxing the layers, the gatherable layer is gathered. For example, one elastic member may be bonded to another member while the elastic member is extended at least about 25% of its relaxed length. Such a multilayer composite elastic material may be stretched until the nonelastic layer is fully extended. One suitable type of stretch-bonded laminate is a spunbonded laminate, such as disclosed in U.S. Pat. No. 4,720,415 to VanderWielen et al., which is incorporated herein in its entirety by reference thereto for all purposes. Another suitable type of stretch-bonded laminate is a continuous fiber spunbonded laminate, such as disclosed in U.S. Pat. No. 5,385,775 to Wright, which is incorporated herein in its entirety by reference thereto for all purposes. For instance, Wright discloses a composite elastic material that includes: (1) an anisotropic elastic fibrous web having at least one layer of elastomeric meltblown fibers and at least one layer of elastomeric filaments autogenously bonded to at least a portion of the elastomeric meltblown fibers, and (2) at least one gatherable layer joined at spaced-apart locations to the anisotropic elastic fibrous web so that the gatherable layer is gathered between the spaced-apart locations. The gatherable layer is joined to the elastic fibrous web when the elastic web is in a stretched condition so that when the elastic web relaxes, the gatherable layer gathers between the spaced-apart bonding locations. Other composite elastic materials are described and disclosed in U.S. Pat. No. 4,789,699 to Kieffer et al., U.S. Pat. No. 4,781,966 to Taylor, U.S. Pat. No. 4,657,802 to Morman, and U.S. Pat. No. 4,655,760 to Morman et al., all of which are incorporated herein in their entirety by reference thereto for all purposes.

In one embodiment, the elastic laminate may also be a necked stretch bonded laminate. As used herein, a necked stretch bonded laminate is defined as a laminate made from the combination of a neck-bonded laminate and a stretch-bonded laminate. Examples of necked stretch bonded laminates are disclosed in U.S. Pat. Nos. 5,114,781 and 5,116,662, which are both incorporated herein in their entirety by reference thereto for all purposes. Of particular advantage, a necked stretch bonded laminate may be stretchable in both the machine and cross-machine directions.

Besides containing multiple layers, the textured fabric may also include a composite of a nonwoven web with another fibrous component. For example, in one particular embodiment, a nonwoven web is entangled with another fibrous component using any of a variety of entanglement techniques known in the art (e.g., hydraulic, air, mechanical, etc.). For example, in some embodiments, the nonwoven web is integrally entangled with cellulosic fibers using hydraulic entanglement. The fibrous component may comprise any desired amount of the resulting fabric. For example, in some embodiments, the fibrous component may comprise greater than about 50% by weight of the fabric, and in some embodiments, from about 60% to about 90% by weight of the fabric. Likewise, in some embodiments, the nonwoven web may comprise less than about 50% by weight of the fabric, and in some embodiments, from about 10% to about 40% by weight of the fabric.

When utilized, the fibrous component may contain cellulosic fibers (e.g., pulp, thermomechanical pulp, synthetic cellulosic fibers, modified cellulosic fibers, and so forth), as well as other types of fibers (e.g., synthetic staple fibers). Some examples of suitable cellulosic fiber sources include virgin wood fibers, such as thermomechanical, bleached and unbleached softwood and hardwood pulps. Secondary or recycled fibers, such as obtained from office waste, newsprint, brown paper stock, paperboard scrap, etc., may also be used. Further, vegetable fibers, such as abaca, flax, milkweed, cotton, modified cotton, cotton linters, may also be used. In addition, synthetic cellulosic fibers such as, for example, rayon and viscose rayon may be used. Modified cellulosic fibers may also be used. For example, the fibrous material may include derivatives of cellulose formed by substitution of appropriate radicals (e.g., carboxyl, alkyl, acetate, nitrate, etc.) for hydroxyl groups along the carbon chain.

The pulp fibers may be high-average fiber length pulp, low-average fiber length pulp, or mixtures of the same. High-average fiber length pulp fibers may have an average fiber length from about 1.5 mm to about 6 mm. Some examples of such fibers may include, but are not limited to, northern softwood, southern softwood, redwood, red cedar, hemlock, pine (e.g., southern pines), spruce (e.g., black spruce), combinations thereof, and so forth. Exemplary high-average fiber length wood pulps include those available from the Kimberly-Clark Corporation under the trade designation "Longlac 19".

The low-average fiber length pulp may be, for example, certain virgin hardwood pulps and secondary (i.e. recycled) fiber pulp from sources such as, for example, newsprint, reclaimed paperboard, and office waste. Hardwood fibers, such as eucalyptus, maple, birch, aspen, and so forth, may also be used. Low-average fiber length pulp fibers may have an average fiber length of less than about 1.2 mm, for example, from 0.7 mm to 1.2 mm. Mixtures of high-average fiber length and low-average fiber length pulps may contain a significant proportion of low-average fiber length pulps. For example, mixtures may contain more than about 50 percent by weight low-average fiber length pulp and less than about 50 percent by weight high-average fiber length pulp. One exemplary mixture contains 75% by weight low-average fiber length pulp and about 25% by weight high-average fiber length pulp.

As stated above, non-cellulosic fibers may also be utilized in the fibrous component. Some examples of suitable non-cellulosic fibers that may be used include, but are not limited to, polyolefin fibers, polyester fibers, nylon fibers, polyvinyl acetate fibers, and mixtures thereof. In some embodiments, the non-cellulosic fibers may be staple fibers, which have, for example, an average fiber length of from about 0.1 inches to about 1 inch, and in some embodiments, from about 0.125 inches to about 0.75 inches. When non-cellulosic fibers are utilized, the fibrous component may contain from about 80% to about 90% by weight cellulosic fibers, such as softwood pulp fibers, and from about 10% to about 20% by weight non-cellulosic fibers, such as polyester or polyolefin staple fibers.

Small amounts of wet-strength resins and/or resin binders may be added to the cellulosic fiber component to improve strength and abrasion resistance. Cross-linking agents and/or hydrating agents may also be added to the pulp mixture. Debonding agents may be added to the pulp mixture. The addition of certain debonding agents in the amount of, for example, about 0.1% to about 4% percent by weight of the fabric also appears to reduce the measured static and dynamic coefficients of friction and improve the abrasion resistance of the composite fabric.

Referring to FIG. 1, one embodiment of the present invention for hydraulically entangling a fibrous component (e.g., cellulosic fibers) with a nonwoven web is illustrated. As shown, a fibrous slurry is conveyed to a conventional papermaking headbox 12 where it is deposited via a sluice 14 onto a conventional forming fabric or surface 16. If desired, the forming surface 16 may have a three-dimensional contour to enhance the texture of the resulting fabric. For instance, some suitable forming fabrics that may be used in the present invention include, but are not limited to, Albany 84M and 94M available from Albany International; Asten 856, 866, 892, 934, 939, 959, or 937; Asten Synweve Design 274, all of which are available from Asten Forming Fabrics, Inc. of Appleton, Wis. Other suitable forming fabrics may be described in U.S. Pat. No. 6,120,640 to Lindsay, et al. and U.S. Pat. No. 4,529,480 to Trokhan, which are incorporated herein in their entirety by reference thereto for all purposes.

The suspension of fibrous material may have any consistency used in conventional papermaking processes. For example, the suspension may contain from about 0.01 to about 1.5% by weight fibrous material suspended in water.

Water is then removed from the suspension of fibrous material to form a uniform layer of the fibrous material 18.

A nonwoven web 20 is unwound from a rotating supply roll 22 and passes through a nip 24 of a S-roll arrangement 26 formed by the stack rollers 28 and 30. The nonwoven web 20 is then placed upon a foraminous entangling surface 32 of a conventional hydraulic entangling machine where the cellulosic fibrous layer 18 is then laid on the web 20. The surface 32 may be, for example, a single plane mesh having a mesh size of from about 8×8 to about 100×100. The foraminous surface 32 may also be a multi-ply mesh having a mesh size from about 50×50 to about 200×200. In some embodiments, to further enhance the texture of the resulting fabric 36, the surface 32 may have a certain pattern. For example, one desirable mesh material may be obtained from Albany International under the designation FormTech 14 Wire. The wire may be described as a 14-C Flat Warp 14×13 mesh, single layer weave. The warp strands are 0.88 mm×0.57 mm of polyester. The shute strands are 0.89 mm polyester. The average caliper is 0.057 inch and the open area is 27.8%.

The cellulosic fibrous layer 18 and nonwoven web 20 pass under one or more hydraulic entangling manifolds 34 and are treated with jets of fluid to entangle the cellulosic fibrous material with the fibers of the nonwoven web 20. Although not required, it is typically desired that the cellulosic fibrous layer 18 be between the nonwoven web 20 and the hydraulic entangling manifolds 34. The jets of fluid also drive cellulosic fibers into and through the nonwoven web 20 to form the composite fabric 36. Alternatively, hydraulic entangling may take place while the cellulosic fibrous layer 18 and nonwoven web 20 are on the same foraminous screen (e.g., mesh fabric) that the wet-laying took place. The present invention also contemplates superposing a dried cellulosic fibrous sheet on a nonwoven web, rehydrating the dried sheet to a specified consistency and then subjecting the rehydrated sheet to hydraulic entangling. The hydraulic entangling may take place while the cellulosic fibrous layer 18 is highly saturated with water. For example, the cellulosic fibrous layer 18 may contain up to about 90% by weight water just before hydraulic entangling. Alternatively, the cellulosic fibrous layer 18 may be an air-laid or dry-laid layer.

Hydraulic entangling may be accomplished utilizing conventional hydraulic entangling equipment such as described in, for example, in U.S. Pat. No. 3,485,706 to Evans, which is incorporated herein in its entirety by reference thereto for all purposes. Hydraulic entangling may be carried out with any appropriate working fluid such as, for example, water. The working fluid flows through a manifold that evenly distributes the fluid to a series of individual holes or orifices. These holes or orifices may be from about 0.003 to about 0.015 inch in diameter and may be arranged in one or more rows with any number of orifices, e.g., 30-100 per inch, in each row. For example, a manifold produced by Honeycomb Systems Incorporated of Biddeford, Me., containing a strip having 0.007-inch diameter orifices, 30 holes per inch, and 1 row of holes may be utilized. However, it should also be understood that many other manifold configurations and combinations may be used. For example, a single manifold may be used or several manifolds may be arranged in succession. Moreover, although not required, the fluid pressure typically used during hydroentangling ranges from about 1000 to about 3000 psig, and in some embodiments, from about 1200 to about 1800 psig. For instance, when processed at the upper ranges of the described pressures, the composite fabric 36 may be processed at speeds of up to about 1000 feet per minute (fpm).

Fluid may impact the cellulosic fibrous layer 18 and the nonwoven web 20, which are supported by a foraminous surface 32. As is typical in many water jet treatment processes, vacuum slots 38 may be located directly beneath the hydro-needling manifolds or beneath the foraminous entangling surface 32 downstream of the entangling manifold so that excess water is withdrawn from the hydraulically entangled composite material 36. Although not held to any particular theory of operation, it is believed that the columnar jets of working fluid that directly impact cellulosic fibers 18 laying on the nonwoven web 20 work to drive those fibers into and partially through the matrix or network of fibers in the web 20. When the fluid jets and cellulosic fibers 18 interact with a nonwoven web 20, the cellulosic fibers 18 are also entangled with fibers of the nonwoven web 20 and with each other. Besides entangling the fibers, the columnar jets of working fluid may also enhance the texture of the resulting fabric.

After the fluid jet treatment, the resulting composite fabric 36 may then be optionally dried using compressive (e.g., Yankee dryer) and/or non-compressive (e.g., through-air dry, infrared, microwave, etc.) drying techniques. Useful through-drying methods may be found in, for example, U.S. Pat. No. 5,048,589 to Cook, et al.; U.S. Pat. No. 5,399,412 to Sudall, et al.; U.S. Pat. No. 5,510,001 to Hermans, et al.; U.S. Pat. No. 5,591,309 to Rugowski, et al.; and U.S. Pat. No. 6,017,417 to Wendt, et al., which are incorporated herein in their entirety by reference thereto for all purposes.

In one particular embodiment, the composite fabric 36 is wet creped. For instance, as shown in FIG. 1, a differential speed pickup roll 40 may be used to transfer the fabric 36 from the hydraulic needling belt to a dryer drum 46 (e.g., Yankee dryer). Specifically, a support surface 50 (e.g., fabric or belt) carries the fabric 36 over the upper portion of the dryer drum 46. The support surface 50 may be patterned in some manner to enhance the texture of the resulting fabric 36. In some embodiments, for instance, the support surface 50 may be a contoured support fabric that contains from about 10 to about 200 machine-direction (MD) knuckles per inch (mesh) and from about 10 to about 200 cross-direction (CD) strands per inch (count). The diameter of such strands may, for example, be less than about 0.050 inches. Further, in some embodiments, the distance between the highest point of the MD knuckle and the highest point of the CD knuckle is from about 0.001 inches to about 0.03 inches. In between these two levels, knuckles may be formed by MD and/or CD strands that give the topography a three-dimensional peak/valley appearance that is ultimately imparted to the fabric 36. Some commercially available examples of such contoured support fabrics include, but are not limited to, Asten 934, 920, 52B, and Velostar V800 made by Asten Forming Fabrics, Inc. Other examples of such contoured fabrics may be described in U.S. Pat. No. 6,017,417 to Wendt et al. and U.S. Pat. No. 5,492,598 to Hermans, et al., which are incorporated herein in their entirety by reference thereto for all purposes.

While on the support surface 50, whether smooth or patterned, the fabric 36 is lightly pressed in engagement with a dryer drum 46 by a press roll 49 to which it adheres due to its moisture content and/or its preference for the smoother of two surfaces. Higher moisture contents may sometimes result in a more textured fabric. The moisture content may be from about 1 wt. % to about 20 wt. %. In some cases, a creping adhesive, such as described below, may be applied to the fabric 36 or drum surface 44 to enhance adhesion. The press roll 49 may be of made any of a variety of materials, such as of steel, aluminum, magnesium, brass, or hard urethane. In some embodiments, the surface of the press roll 49 may be controlled to enhance the texture of the resulting fabric. For example, the press roll 49 may have a patterned surface or be wrapped with a patterned fabric, as is well known in the art. The patterned surface may be utilized to impart peaks onto the "roll side" of the fabric 36, i.e., the side of the fabric 36 facing the roll 49. The press roll 49 may press the fabric 36 against the drum 46 at a variety of pressures. The roll pressure may be optimized to enhance the texture of the resulting fabric. When, for instance, the support surface 50 and/or roll 49 is patterned, the texture of the resulting fabric may be enhanced by using higher roll pressures to press the fabric 36 against the drum 46. Of course, the roll pressure may be set low enough to maintain the durability and strength of the fabric 36. For instance, in some embodiments, the roll pressure may be from about 50 pounds per linear inch (pli) to about 350 pli, in some embodiments from about 100 to about 300 pli, and in some embodiments, from about 150 to about 250 pli.

As the fabric 36 is carried over the drum surface 44, heat is imparted to the fabric 36, and most of the moisture is typically evaporated. The fabric 36 is then optionally removed from the drum surface 44 by a creping blade 47. That is, the blade 47 imparts a series of fine fold lines (crepe bars) to the portions of the fabric 36 that adhere to the creping surface 44. Of course, other creping techniques may also be utilized in the present invention. For example, in some embodiments, the fabric 36 may be creped using a "microcreping" process. For instance, some suitable microcreping processes are described in U.S. Pat. No. 3,260,778 to Walton; U.S. Pat. No. 4,919,877 to Parsons, et al.; U.S. Pat. No. 5,102,606 to Ake, et al.; U.S. Pat. No. 5,498,232 to Scholz; and U.S. Pat. No. 5,972,039 to Honeycutt, et al., which are all incorporated herein in their entirety by reference thereto for all purposes. Commercially available microcreping equipment may be obtained from Micrex Corporation of Walpole, Mass.

Figure 2:
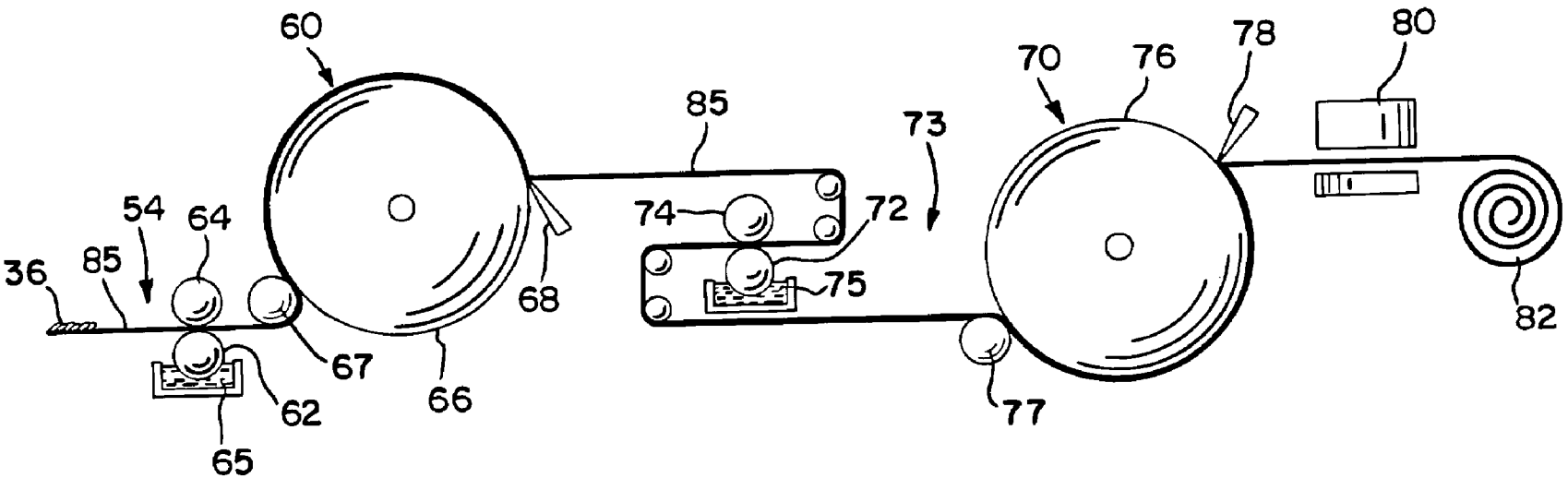
FIG. 2 is a schematic illustration of a process for creping a fabric in accordance with one embodiment of the present invention.

In addition to or in lieu of wet creping, the fabric may be subjected to a dry creping process (e.g., single recreping (SRC), double recreping (DRC), etc.). For example, some suitable dry creping techniques are described in U.S. Pat. No. 3,879,257 to Gentile, et al.; U.S. Pat. No. 6,315,864 to Anderson, et al.; and U.S. Pat. No. 6,500,289 to Merker, et al., which are incorporated herein in their entirety by reference thereto for all purposes. Referring to FIG. 2, for instance, one method for dry creping the fabric in accordance with the present invention is illustrated. As shown, the fabric 36 is disposed on a support surface 85, such as a wire or fabric. As described above, the support surface 85 may be smooth or patterned.

While on the support surface 85, the fabric 36 is passed through an adhesive application station 54. This station 54 includes a nip formed by a smooth rubber press roll 64 and a patterned metal rotogravure roll 62. The lower transverse portion of the rotogravure roll 62 is disposed in a bath 65 containing a creping adhesive. A wide variety of creping adhesives may be used in the present invention. For instance, some suitable adhesives that may be used include, but are not limited to, aqueous-based styrene butadiene adhesives, neoprene, polyvinyl chloride, vinyl copolymers, polyamides, ethylene vinyl terpolymers and combinations thereof. One particularly suitable adhesive is an acrylic polymer emulsion sold by Noveon, Inc. under the trade name HYCAR.

The percent adhesive coverage of the fabric 36 may be selected to obtain varying levels of creping, which may also result in varying levels of texture. For instance, greater adhesive coverage may result in a greater degree of creping, which in turn, results in a more textured material. Nonetheless, too high a degree of creping may sometimes reduce the strength of the fabric below desired levels. Thus, to balance these concerns, the adhesive coverage may be from about 5% to 95% of the fabric surface, in some embodiments from about 10% to about 70% of the fabric surface, and in some embodiments, from about 25% to about 50% of the fabric surface. The adhesive may also penetrate the fabric 36 in the locations where it is applied. In particular, the adhesive may penetrate through about 10% to about 50% of the fabric thickness, although there may be greater or less adhesive penetration at some locations.

Referring again to FIG. 2, the rotogravure roll 62 applies an engraved pattern of the creping adhesive to one surface of the fabric 36. The fabric 36 may optionally be passed through a drying station (not shown) where the adhesive is partially dried or set. The drying station may include any form of heating unit well known in the art, such as ovens energized by infrared heat, microwave energy, hot air, etc. The fabric 36 is then pressed into adhering contact with the creping drum 60 by the press roll 67. As described above, the pattern and/or pressure of the press roll 67 may be varied to optimize the texture of the resulting fabric 36. After being pressed against the drum 60, the fabric 36 is carried on the surface 66 of the drum 60 for a distance and then removed therefrom by the action of a creping blade 68.

The other side of the fabric 36 may be creped using a second creping station 73, regardless of whether or not the first creping station 54 is bypassed. The second adhesive application station 73 is illustrated by smooth rubber press roll 74, rotogravure roll 72, and a bath 75 containing a second adhesive. This adhesive is also applied to the fabric 36 in a pattern arrangement, although not necessarily in the same pattern as that in which the first adhesive is applied to the first side. Even if the two patterns are the same, it is not necessary to register the two patterns to each other. In addition, the same or different adhesive may be applied at the second adhesive application station 73. The rotogravure roll 72 applies an engraved pattern of the creping adhesive to one surface of the fabric 36. The fabric 36 is then pressed into adhering contact with the creping drum 70 by the press roll 77. After being pressed against the drum 70, the fabric 36 is carried on the surface 76 of the drum 70 for a distance and then removed therefrom by the action of a creping blade 78. After creping, the fabric may optionally be passed through a chilling station 80 and wound onto a storage roll 82 before being coated with the treatment composition.

The present inventors have discovered that the use of wet and/or dry creping may enhance the texture of the fabric by imparting a series of fold lines to the portions of the fabric that adhere to the creping surface. As indicated above, the level of texture imparted may be enhanced by controlling the level of adhesion and the pressure applied to the fabric. The textured effect may be further enhanced by selectively controlling the geometry of the creping blade and the amount of draw on the fabric after it is creped. In addition to providing texture to the fabric, creping may also cause any pulp fibers contained in the fabric to puff up and spread apart, thereby increasing softness and bulk. Creping may also enhance the stretchability of the web in the machine and/or cross-machine directions.

It may also be desirable to use other finishing steps and/or post treatment processes to impart selected properties to the fabric 36. For example, the fabric 36 may be lightly pressed by calender rolls, brushed or otherwise treated to enhance stretch and/or to provide a uniform exterior appearance and/or certain tactile properties. In one particular embodiment, the fabric 36 may be embossed in a finishing step to further enhance its texture. A pattern may be embossed into one side of the fabric or into both sides. For instance, the fabric may be impressed between a patterned or smooth press roll and an embossing roll containing a raised pattern.

The basis weight of the resulting textured fabric may range from about 20 to about 200 grams per square meter (gsm), in some embodiments from about 30 to about 175 grams per square meter, and in some embodiments, from about 50 gsm to about 150 gsm. Lower basis weight products are typically well suited for use as light duty wipers, while the higher basis weight products are better adapted for use as industrial wipers.

B. Treatment Composition

In some embodiments, the treatment composition is an aqueous composition that contains a curable latex polymer. Various examples of such a composition are described in U.S. Pat. No. 5,853,859 to Levy, et al., which is incorporated herein in its entirety by reference thereto for all purposes. When applied to the fabric and dried, the treatment composition remains colorfast, even after exposure to many common cleaning chemicals. For instance, the coated fabric, when dried, may retain a colorfastness above 3 when exposed to liquids with a pH from about 2 to about 13.

The latex polymer of the treatment composition may be crosslinkable at room temperature or at slightly raised temperatures, stable at ambient weather conditions, and relatively flexible when cured. Examples of such latex polymers include, but are not limited to, ethylene vinyl acetate polymers, ethylene vinyl chloride polymers, styrene-butadiene polymers, acrylate polymers, and styrene-acrylate copolymers, and so forth. Such latex polymers may have a glass transition temperature ($T_g$) in the range of from about −15° C. to about +20° C. One suitable commercially available latex polymer is available from Noveon, Inc. of Cleveland, Ohio under the trade name HYCAR 26084. Other commercially available latex polymers include HYCAR 2671, 26445, 26322, 26684, and 26469 from Noveon, Inc.; RHOPLEX B-15, HA-8 and NW-1715 from Rohm & Haas; BUTOFAN 4261 and STYRONAL 4574 from BASF of Chattanooga, Tenn.

A variety of cure promoters may be used in conjunction with the latex polymer. Although not required, the cure promoter may facilitate the crosslinking of the latex polymer in the composition. In some embodiments, the cure promoter may facilitate crosslinking at or slightly above room temperature so that the fabric is not heated above its melting temperature during curing. In one particular embodiment, the cure promoter becomes active at a pH that is neutral or acidic so that the composition is kept at a pH of above 8 during mixing and application. The pre-cure pH of the composition is kept above 8 by the use of a fugitive alkali, such as ammonia. Fugitive alkalis remain in solution until driven off by drying at room temperature, or alternatively, heating them a small amount to increase the evaporation rate. In any event, the curing temperature may be at a temperature below the melting temperature of the fabric. The loss of the alkali causes a drop in the pH of the composition that triggers the action of the cure promoter. Examples of some cure promoters that may be used in the present invention include, but are not limited to, XAMA-2, XAMA-7, and CX-100, which are available commercially from Noveon, Inc. of Cleveland, Ohio. Another suitable cure promoter is CHEMTITE PZ-33, which is available from the Nippon Shokubai Co. of Osaka, Japan. These materials are aziridine oligomers or polymers with at least two aziridine functional groups.

A pigment may also be used that is compatible with the latex polymer and cure promoter. A pigment may contain particulate color bodies as opposed to liquids. Some examples of commercially available pigments that may be used in the present invention include, but are not limited to, pigments available from Clariant Corp. of Charlotte, N.C., under the trade designation GRAPHTOL®. Particular pigments include GRAPHTOL 1175-2 (red), GRAPHTOL 6825-2 (blue), GRAPHTOL 5869-2 (green), and GRAPHTOL 4534-2 (yellow). Other suitable pigments include CATARENE Blue HC 153 Paste, CATARENE Red HC 269 Paste, and CATARENE Blue HC 740 Paste, which are also available from Clariant Corp. Combinations of these pigments may be used to provide various other colors.

In addition to or perhaps in place of some of the pigment, a filler such as clay may be used as an extender. A clay that may be used is, for example, ULTRAWHITE 90, available from the Englehard Corp. of Iselin, N.J. An optional viscosity modifier may also be used to decrease or increase the viscosity of the treatment composition. One such suitable viscosity-increasing modifier is known as ACRYSOL (RM-8) and is available from the Rohm & Haas Company of Philadelphia, Pa. Another suitable viscosity-increasing modifier is ZINPOL 520, an acrylic polymer available from Noveon, Inc. If it is desired to reduce the viscosity of the treatment composition, water may simply be added. The ability to add water is one indication of the ease of use and flexibility of this composition.

The amounts of each component used in the treatment composition may vary. For instance, the latex polymer may comprise from about 10 wt. % to about 45%, in some embodiments from about 20 wt. % to about 40 wt. %, and in some embodiments, from about 30 wt. % to about 40 wt. % of the treatment composition. In addition, the cure promoter may comprise from about 0.1 wt. % to about 10%, in some embodiments from about 0.5 wt. % to about 5 wt. %, and in some embodiments, from about 0.75 wt. % to about 2 wt. % of the treatment composition. The pigment may comprise from about 1 wt. % to about 20%, in some embodiments from about 2 wt. % to about 15 wt. %, and in some embodiments, from about 5 wt. % to about 10 wt. % of the treatment composition. As indicated above, the final viscosity of the composition may be adjusted with viscosity modifiers to provide the desired viscosity.

C. Application of Treatment Composition

Figure 4:
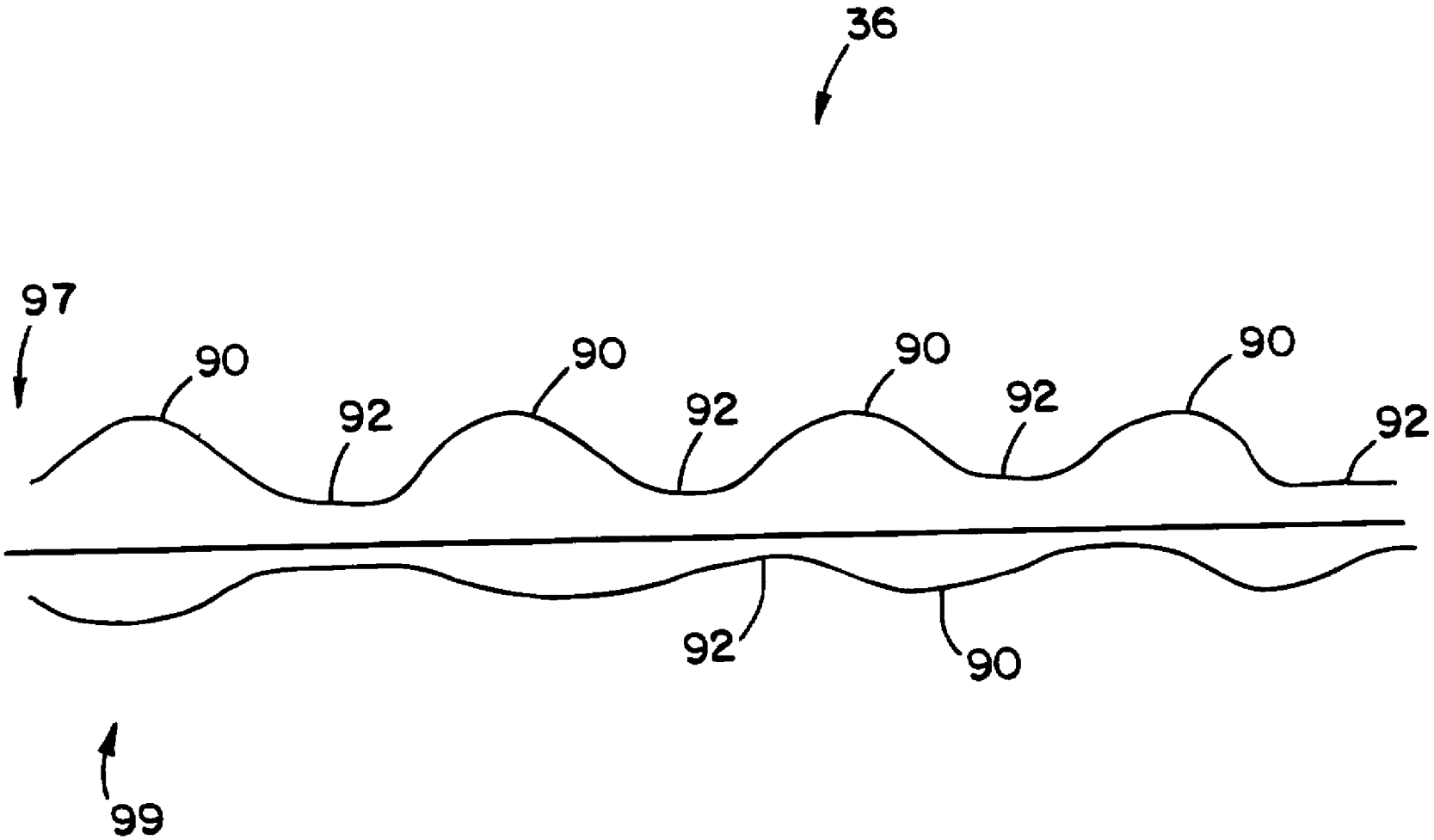
FIG. 4 is a perspective view of a textured fabric having peaks and valleys in accordance with one embodiment of the present invention.

As indicated above, the textured fabric of the present invention contains peaks and valleys. More particularly, each side may possess peaks and valleys, although embodiments in which only one side contains peaks and valleys are certainly covered by the present invention. Referring to FIG. 4, for instance, one embodiment of a textured fabric 36 is shown that contains two surfaces 97 and 99, each having peaks 90 and valleys 92 disposed at a different elevation than the peaks 90. As illustrated, the peaks 90 define the user-contacting surfaces for the fabric 36. The valleys 92 do not come into contact with other surfaces during use. Because the peaks 90 contact various other surfaces (e.g., hands, counters, etc.) during use, fibers thereon may be freed from the fabric 36, thereby creating lint.

To reduce lint, the treatment composition is thus applied to the peaks 90 of the fabric 36. For example in some embodiments, greater than about 90%, and in some embodiments, approximately 100% of the peaks 90 are coated with the treatment composition. However, to maintain the absorbency of the fabric 36, it is also desired that that the valleys 92 remain free of the treatment composition, which may be hydrophobic. For example in some embodiments, less than about 10%, and in some embodiments, approximately 0% of the valleys 92 are coated with the treatment composition. To achieve such a coating distribution, 75 wt. % or greater, and in some embodiments, 90 wt. % or greater of the treatment composition is ultimately disposed on the peaks 90 of the textured fabric 36.

Figure 3:
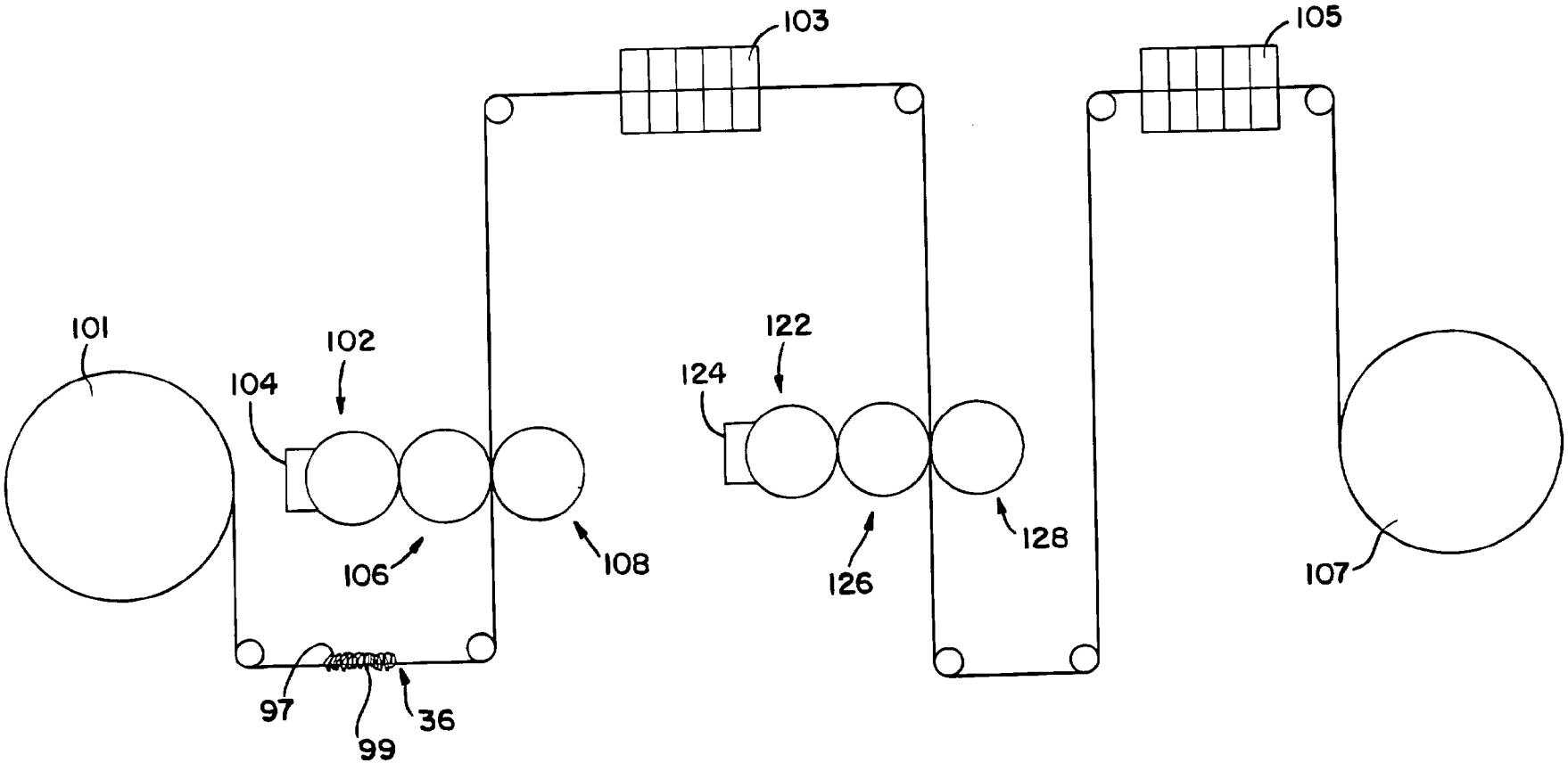
FIG. 3 is a schematic illustration of a process for coating a textured fabric in accordance with one embodiment of the present invention.

A variety of techniques may be used for applying the treatment composition to the peaks 90 of the fabric 36 in the above-described manner. Referring to FIG. 3, one embodiment of a flood coating process that may be used to apply the treatment composition to the peaks 90 of the surfaces 97 and/or 99 of the fabric 36 (See FIG. 4) is illustrated. To flood coat the surface 97 of the fabric 36, for instance, the fabric 36 is unwound from a roll 101. Alternatively, the fabric 36 may be supplied directly from a drying or creping operation, such as discussed above. A first rotatable metering roll 102 dips into a bath 104 containing the treatment composition. Upon axial rotation, the metering roll 102 acquires the treatment composition from the bath 104, wherein continuous cells (not shown) of the metering roll 102 are filled. The roll 102 then transfers the treatment composition to a transfer roll 106. The fabric 36 passes through the gap between the transfer roll 106 having the treatment composition uniformly disposed thereon and an anvil roll 108. The peaks 90 of the fabric 36 project toward and contact the transfer roll 106.

As the fabric 36 passes through the gap between the transfer roll 106 and the anvil roll 108, the treatment composition is applied to only the peaks 90 of the fabric 36. The transfer roll 106 does not contact the valleys 92 of the fabric 36 that rest against the anvil roll 108. Accordingly, little or no treatment composition is applied to the valleys 92. Upon application, the treatment composition may be dried by a conventional dryer 103, which in some instances, drives off the alkali to cause a drop in the pH of the composition and activate the cure promoter. The treatment composition may also be flood coated onto the peaks 90 on the surface 99 of the fabric 36 using a second metering roll 122, a second bath 124, a second transfer roll 126, and a second anvil roll 128 in the manner described above. This additional treatment composition may also be dried using a dryer 105. The treated fabric 36 may then be wound up on a roll 107. Other suitable coating equipment and methods may also be described in U.S. Pat. No. 5,085,514 to Mallik, et al.; U.S. Pat. No. 5,922,406 to Ludford, Ill.; and U.S. Pat. No. 6,299,729 to Heath, et al., which are incorporated herein in their entirety by reference thereto for all purposes.

In contrast to "pattern printing", which only coats a certain percentage of a surface, coating techniques, such as described above, may uniformly coat the entire user-contacting surface defined by the peaks 90. Moreover, to maintain the absorbency of the fabric 36, the valleys 92 remains substantially uncoated. This is accomplished because only the peaks 90 contact the transfer roll 106 during the coating process, and thus, the treatment composition is applied only to such peaks. Other techniques for uniformly coating a surface in this manner may also be utilized in the present invention. For instance, known gravure, offset, flexographic, and size press printing equipment may also be used in the present invention to apply a coating to an entire user-contacting surface.

The solids add-on level and depth percentage of the treatment composition may vary as desired. The "solids add-on level" is determined by subtracting the weight of the untreated fabric from the weight of the treated fabric (after drying), dividing this calculated weight by the weight of the uncoated fabric, and then multiplying by 100%. The depth percentage is determined by dividing the depth of the coating by the total caliper of the fabric (coated and uncoated), and multiplying by 100%. Lower add-on levels and depth percentages may provide optimum absorbency, while higher add-on levels and depth percentages may provide optimum lint reduction and durability. In some embodiments, for example, the add-on level is from about 0.1% to about 20%, in some embodiments from about 0.1% to about 10%, and in some embodiments, from about 0.5% to about 5%. In addition, the depth percentage of the coating may be from about 1% to about 30%, in some embodiments from about 1% to about 20%, and in some embodiments, from about 5% to about 15%.

The present invention may be better understood with reference to the following examples. The following test methods were used in the Examples.

Test Methods

Gelbo Lint: The amount of lint for a given sample was determined according to the Gelbo Lint Test. The Gelbo Lint Test determines the relative number of particles released from a fabric when it is subjected to a continuous flexing and twisting movement. It is performed in accordance with INDA test method 160.1-92. A sample is placed in a flexing chamber. As the sample is flexed, air is withdrawn from the chamber at 1 cubic foot per minute for counting in a laser particle counter. The particle counter counts the particles by size for less than or greater than 25 microns using channels to size the particles. The results may be reported as the total particles counted over 10 consecutive 30-second periods, the maximum concentration achieved in one of the ten counting periods or as an average of the ten counting periods. The test indicates the lint generating potential of a material.

Taber Abrasion resistance: Taber Abrasion resistance measures the abrasion resistance in terms of destruction of the fabric produced by a controlled, rotary rubbing action. Abrasion resistance is measured in accordance with Method 5306, Federal Test Methods Standard No. 191A, except as otherwise noted herein. Only a single wheel is used to abrade the specimen. A 12.7×12.7-cm specimen is clamped to the specimen platform of a Taber Standard Abrader (Model No. 504 with Model No. E-140-15 specimen holder) having a rubber wheel (No. H-18) on the abrading head and a 500-gram counterweight on each arm. The loss in breaking strength is not used as the criteria for determining abrasion resistance. The results are obtained and reported in abrasion cycles to failure where failure was deemed to occur at that point where a 1.25-cm hole is produced within the fabric.

Absorption Capacity: The absorption capacity refers to the capacity of a material to absorb liquid over a period of time and is related to the total amount of liquid held by the material at its point of saturation. The absorption capacity is measured in accordance with Federal Specification No. UU-T-595C on industrial and institutional towels and wiping papers. Specifically, absorption capacity is determined by measuring the increase in the weight of the sample resulting from the absorption of a liquid and is expressed, in percent, as the weight of liquid absorbed divided by the weight of the sample by the following equation:

$$\text{Absorption Capacity}=[(\text{saturated sample weight}-\text{sample weight})/\text{sample weight}]\times 100.$$

Colorfastness: Colorfastness refers to the transfer of a colored material from a sample as determined by a colorfastness to crocking test. Colorfastness to crocking is measured by placing a 5-inch×7-inch (127 mm by 178 mm) piece of the sample into a Crockmeter model available from the Atlas Electric Device Company of Chicago, Ill. The crockmeter strokes or rubs a cotton cloth back and forth across the sample a predetermined number of times (in the tests herein the number was 30) with a fixed amount of force. The color transferred from the sample onto the cotton is then compared to a scale wherein 5 indicates no color on the cotton and 1 indicates a large amount of color on the cotton. A higher number indicates a more colorfast sample. The comparison scale is available from the American Association of Textile Chemists and Colorists (MTCC), Research Triangle Park, N.C.

Grab Tensile Strength: The grab tensile test is a measure of breaking strength of a fabric when subjected to unidirectional stress. This test is known in the art and conforms to the specifications of Method 5100 of the Federal Test Methods Standard 191A. The results are expressed in pounds to break. Higher numbers indicate a stronger fabric. The grab tensile test uses two clamps, each having two jaws with each jaw having a facing in contact with the sample. The clamps hold the material in the same plane, usually vertically, separated by 3 inches (76 mm) and move apart at a specified rate of extension. Values for grab tensile strength are obtained using a sample size of 4 inches (102 mm) by 6 inches (152 mm), with a jaw facing size of 1 inch (25 mm) by 1 inch, and a constant rate of extension of 300 mm/min. The sample is wider than the clamp jaws to give results representative of effective strength of fibers in the clamped width combined with additional strength contributed by adjacent fibers in the fabric. The specimen is clamped in, for example, a Sintech 2 tester, available from the Sintech Corporation of Cary, N.C., an Instron Model™, available from the Instron Corporation of Canton, Mass., or a Thwing-Albert Model INTELLECT II available from the Thwing-Albert Instrument Co. of Philadelphia, Pa. This closely simulates fabric stress conditions in actual use. Results are reported as an average of three specimens and may be performed with the specimen in the cross direction (CD) or the machine direction (MD).

EXAMPLE 1

A composite fabric was formed to have peaks and valleys according to U.S. Pat. No. 5,284,703 to Everhart, et al. Specifically, northern softwood kraft pulp fibers were deposited onto an Albany 84M forming wire available from Albany International, and hydraulically entangled with a polypropylene spunbond web (basis weight of 27 grams per square meter) with entangling pressures of up to about 1600 pounds per square inch. The entangling wire was Form Tech 14 available from Albany International. After entangling, the fabric was transferred to a drying fabric available from Albany International under the name "Aerogrip" and dried with drying cans (at a temperature of 250° F.) so that it reached a maximum temperature of 200° F.

The fabric was then transferred to a Yankee wire available from Albany International under the name "Monodri 1", adhered to a Yankee drum, and creped. The adhesive used was an ethylene/vinyl acetate copolymer latex adhesive available from Air Products, Inc. under the name "Airflex A-105" (viscosity of 95 cps and 28% solids). A roll pressed the fabric against the Yankee drum at a pressure of 200 pounds per linear inch. The creping blade holder angle was 21° and the grind angle was 20°. The resulting fabric had a basis weight of about 125 grams per square meter, and contained approximately 40% by weight of the spunbond web and approximately 60% of the pulp fiber component.

The following composition was then applied to the fabric:

TABLE 1

| Treatment Composition | |
|---|---|
| Components | Wt. % |
| Hycar 26684[1] | 27.40 |
| BubbleBreaker 748[2] | 0.13 |
| 28% Ammonia | 0.53 |
| Zinpol 520[3] | 31.23 |

TABLE 1-continued

| Treatment Composition | |
|---|---|
| Components | Wt. % |
| GRAPHTOL Red 1116-2ps | 1.10 |
| GRAPHTOL Blue 6825-2ps | 3.29 |
| XAMA-7[4] | 0.82 |
| Water | 35.51 |

[1]An acrylic latex polymer available from Noveon, Inc.
[2]A defoamer available from CK Witco, Inc.
[3]An acrylic thickener available from Noveon, Inc.
[4]A polyfunctional aziridine cure promoter available from Noveon, Inc.

The composition was prepared by adding the indicated amount of latex polymer as an aqueous mixture with a fugitive alkali, in this case ammonia, to a pH of about 9. The indicated amount of pigment was then added and the pH rechecked and adjusted if necessary. Lastly, the cure promoter was added and the viscosity was checked and adjusted with the viscosity modifier, to a final pre-cure viscosity of 75 centipoise. The composition had a solids add-on level of 1.0%.

Figure 5:
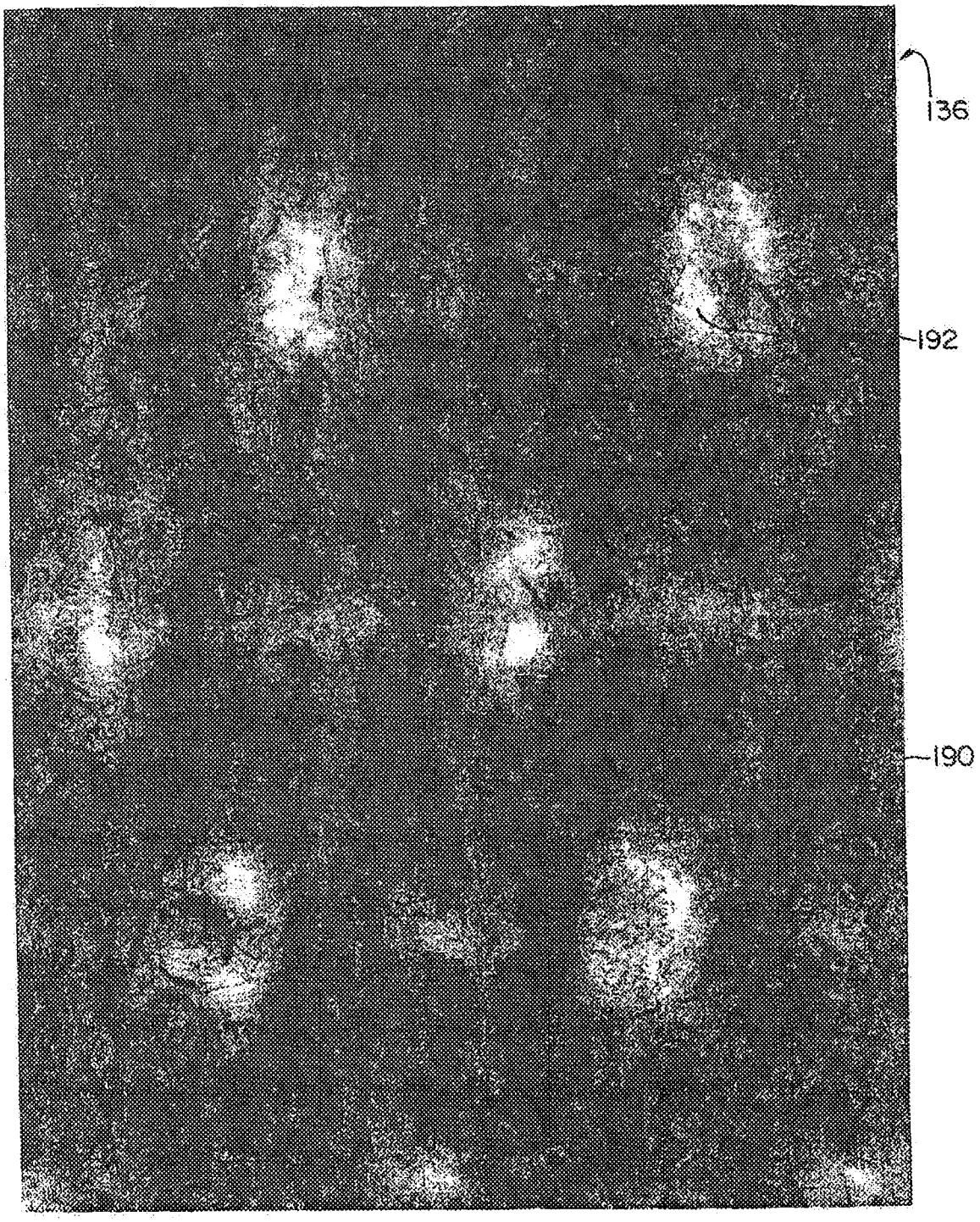
FIG. 5 is a microphotograph of a cross section of a treated textured fabric formed according to Example 1.

To apply the composition, the flood coating technique shown in FIG. 3 was utilized. The metering rolls (e.g., roll 102 and roll 122) were engraved analox rolls having 300 cells (lines) per inch of their surface. The first metering roll (e.g., roll 102) had a Shore A hardness of 55 and a cell volume of 6.9 BCM (billion cubic micrometers), while the second metering roll (e.g., roll 122) had a Shore A hardness of 65 and a cell volume of 6.9 BCM. A microphotograph of one side of the coated fabric is shown in FIG. 5. As depicted, the fabric 136 contains peaks 190 and valleys 192. The lighter shade of the valleys 192 evidences the absence of the treatment composition, while the darker shade of the peaks 190 evidences the presence of the composition.

Upon formation, the absorbent capacity and colorfastness of the fabric was tested as set forth above. To measure colorfastness, samples of the fabric were dipped into the subject solutions and allowed to remain in the solution for 5 minutes. Each sample was then removed from the solution and placed in the crockmeter while still wet and tested according to the test procedure. In addition, a sample coated with the treatment composition using "pattern printing" was also tested. For this sample, the composition was printed onto both sides the fabric using flexographic printing and dried at room temperature. The printing applied a solids add-on level of 0.4% to each side with about 48% print coverage.

The results are shown below in Table 2.

TABLE 2

| Test Results for 125 GSM Fabric | | | |
|---|---|---|---|
| Sample | Absorption Capacity (%) | | Colorfastness |
| Flood Coated | Water | 4.4 | N/A |
| | Windex ® | 2.5 | 2.0 |
| | Cooking Oil | 4.9 | N/A |
| 2-Side Pattern Printed | Water | 4.1 | N/A |
| | Windex ® | 2.3 | 2.0 |
| | Cooking Oil | 4.2 | N/A |

As indicated above, the absorbent capacity and colorfastness was not substantially reduced when using the flood coating technique.

EXAMPLE 2

A composite fabric was formed to have peaks and valleys substantially as described above in Example 1, except that the resulting fabric had a total basis weight of 82 grams per square meter. The following composition was then applied to the fabric:

TABLE 3

| Treatment Composition | |
|---|---|
| Components | Wt. % |
| Hycar 26684[1] | 32.98 |
| BubbleBreaker 748[2] | 0.16 |
| 28% Ammonia | 0.63 |
| Zinpol 520[3] | 21.58 |
| CATARENE Red HC 269 Paste | 9.13 |
| XAMA-7[4] | 1.89 |
| Water | 33.62 |

[1]An acrylic latex polymer available from Noveon, Inc.
[2]A defoamer available from CK Witco, Inc.
[3]An acrylic thickener available from Noveon, Inc.
[4]A polyfunctional aziridine cure promoter available from Noveon, Inc.

The composition was prepared by adding the indicated amount of latex polymer as an aqueous mixture with a fugitive alkali, in this case ammonia, to a pH of about 9. The indicated amount of pigment was then added and the pH rechecked and adjusted if necessary. Lastly, the cure promoter was added and the viscosity was checked and adjusted with the viscosity modifier, to a final pre-cure viscosity of 75 centipoise. The composition was applied using the flood coating technique of Example 1. The solids add-on level was 1.8%.

Various properties of the fabric were then tested as set forth above. In addition, a sample coated with the treatment composition using "pattern printing" was also tested. For this sample, the composition was printed onto both sides the fabric using flexographic printing and dried at room temperature. The printing applied a solids add-on level of 0.7% to each side with about 48% print coverage. Another sample was also tested that contained no treatment composition.

The results are shown below in Table 4.

TABLE 4

| Test Results for 82 GSM Fabric | | | | | | | | |
|---|---|---|---|---|---|---|---|---|
| | | | MD Grab Tensile | CD Grab Tensile | Taber Abrasion | Gelbo Lint | | Water Absorption |
| Sample | Colorfastness | | Strength (lbs) | Strength (lbs) | Resistance (cycles) | <25 microns | <25 microns | Capacity (%) |
| Flood Coated | Encompass ™ | 3.0 | 17.3 | 13.4 | 61.4 | 208 | 26 | 3.9 |
| | Disinfectant | 2.0 | | | | | | |
| | Windex ™ | 2.0 | | | | | | |
| | Fantistik ™ | 2.0 | | | | | | |
| | Vinegar | 2.0 | | | | | | |
| | Bleach | 3.0 | | | | | | |
| 2-Side Pattern Printed | Encompass ™ | 3.5 | 19.1 | 13.1 | 64.8 | 250 | 51 | 4.2 |
| | Disinfectant | 3.0 | | | | | | |
| | Windex ™ | 3.5 | | | | | | |
| | Fantistik ™ | 4.0 | | | | | | |
| | Vinegar | 3.5 | | | | | | |
| | Bleach | 4.0 | | | | | | |
| Uncoated | N/A | | 16.8 | 12.1 | 67.4 | 260 | 55 | 4.6 |

As indicated above, the flood coated sample exhibited relatively low levels of lint while substantially maintaining its other properties.

EXAMPLE 3

A composite fabric was formed to have peaks and valleys substantially as described above in Example 1, except that the resulting fabric had a total basis weight of 54 grams per square meter. The following composition was then applied to the fabric:

TABLE 5

| Treatment Composition | |
|---|---|
| Components | Wt. % |
| Hycar 26684[1] | 27.40 |
| BubbleBreaker 748[2] | 0.13 |
| 28% Ammonia | 0.53 |
| Zinpol 520[3] | 31.23 |
| GRAPHTOL Red 1116-2ps | 1.10 |
| GRAPHTOL Blue 6825-2ps | 3.29 |
| XAMA-7[4] | 0.82 |
| Water | 35.51 |

[1]An acrylic latex polymer available from Noveon, Inc.
[2]A defoamer available from CK Witco, Inc.
[3]An acrylic thickener available from Noveon, Inc.
[4]A polyfunctional aziridine cure promoter available from Noveon, Inc.

The composition was prepared by adding the indicated amount of latex polymer as an aqueous mixture with a fugitive alkali, in this case ammonia, to a pH of about 9. The indicated amount of pigment was then added and the pH rechecked and adjusted if necessary. Lastly, the cure promoter was added and the viscosity was checked and adjusted with the viscosity modifier, to a final pre-cure viscosity of 75 centipoise. The composition was applied using the flood coating technique of Example 1. The solids add-on level was approximately 1.8%.

Various properties of the fabric were then tested as set forth above. In addition, a sample coated with the treatment composition using "pattern printing" was also tested. For this sample, the composition was printed onto both sides the fabric using flexographic printing and dried at room temperature. The printing applied a solids add-on level of 0.7% to each side with about 48% print coverage. Another sample was also tested that contained no treatment composition.

The results are shown below in Table 6.

TABLE 6

Test Results for 54 GSM Fabric

| Sample | Gelbo Lint <25 microns | Gelbo Lint >25 microns | Water Absorption Capacity (%) |
|---|---|---|---|
| Flood Coated | 77.2 | 15.2 | 4.3 |
| 2-Side Pattern Printed | 58.2 | 12.8 | 4.5 |
| Uncoated | 159.2 | 28.8 | 5.1 |

As indicated above, the flood coated sample exhibited relatively low levels of lint while substantially maintaining its water absorption capacity.

EXAMPLE 4

A composite fabric was formed to have peaks and valleys substantially as described above in Example 1, except that the resulting fabric had a total basis weight of 54 grams per square meter. The following composition was then applied to the fabric:

TABLE 7

Treatment Composition

| Components | Wt. % |
|---|---|
| Hycar 26684[1] | 32.98 |
| BubbleBreaker 748[2] | 0.16 |
| 28% Ammonia | 0.63 |
| Zinpol 520[3] | 21.58 |
| CATARENE Blue HC 153 Paste | 9.13 |
| XAMA-7[4] | 1.89 |
| Water | 33.62 |

[1]An acrylic latex polymer available from Noveon, Inc.
[2]A defoamer available from CK Witco, Inc.
[3]An acrylic thickener available from Noveon, Inc.
[4]A polyfunctional aziridine cure promoter available from Noveon, Inc.

The composition was prepared by adding the indicated amount of latex polymer as an aqueous mixture with a fugitive alkali, in this case ammonia, to a pH of about 9. The indicated amount of pigment was then added and the pH rechecked and adjusted if necessary. Lastly, the cure promoter was added and the viscosity was checked and adjusted with the viscosity modifier, to a final pre-cure viscosity of 75 centipoise. The composition was applied using the flood coating technique of Example 1. The solids add-on level was approximately 2.8%.

Various properties of the fabric were then tested as set forth above. In addition, a sample coated with the treatment composition using "pattern printing" was also tested. For this sample, the composition was printed onto both sides the fabric using flexographic printing and dried at room temperature. The printing applied a solids add-on level of 1.41 to each side with about 48% print coverage.

The results are shown below in Table 8.

TABLE 8

Test Results for 54 GSM Fabric

| Sample | Colorfastness (Windex ™) | Absorption Capacity (%) | |
|---|---|---|---|
| Flood Coated | 1.5 | Water | 4.7 |
| | | Windex ™ | 4.2 |
| | | Cooking Oil | 6.6 |
| 2-Side Pattern Printed | 1.0 | Water | 5.1 |
| | | Windex ™ | 4.5 |
| | | Cooking Oil | 7.2 |

As indicated above, the flood coated sample was able to exhibit low colorfastness and substantially maintain its absorption capacity.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A textured composite fabric comprising a nonwoven web that is entangled with a fibrous component and then creped, the creped fabric having at least one surface that contains peaks and valleys, wherein greater than about 90% of the peaks and less than about 10% of the valleys are applied with a treatment composition, the treatment composition comprising a latex polymer, wherein the peaks define a user-contacting surface.

2. The textured composite fabric of claim 1, wherein approximately 100% of the peaks are applied with the treatment composition.

3. The textured composite fabric of claim 1, wherein approximately 0% of the valleys are applied with the treatment composition.

4. The textured composite fabric of claim 1, wherein the solids add-on level of the treatment composition is from about 0.1% to about 20%.

5. The textured composite fabric of claim 1, wherein the solids add-on level of the treatment composition is from about 0.5% to about 5%.

6. The textured composite fabric of claim 1, wherein the latex polymer is selected from the group consisting of ethylene vinyl acetates, ethylene vinyl chlorides, styrene-butadiene, acrylates and styrene-acrylate copolymers.

7. The textured composite fabric of claim 1, wherein the nonwoven web is a spunbond web.

8. The textured composite fabric of claim 1, wherein the fibrous component contains cellulosic fibers.

9. The textured composite fabric of claim 1, wherein the fibrous component comprises greater than about 50% by weight of the fabric.

10. The textured composite fabric of claim 1, wherein the fibrous component comprises from about 60% to about 90% by weight of the fabric.

11. The textured composite fabric of claim 1, wherein the treatment composition further comprises a pigment.

12. The textured composite fabric of claim 1, wherein the nonwoven woven web is thermally, ultrasonically, adhesively, or mechanically bonded.

13. The textured composite fabric of claim 12, wherein the nonwoven woven web is point bonded.

14. The textured composite fabric of claim 1, wherein the nonwoven web is hydraulically entangled with the fibrous component.

15. The textured composite fabric of claim 1, wherein the peaks define a user-contacting surface that is substantially uniformly coated with the treatment composition.

16. A textured composite fabric comprising a nonwoven web that is hydraulically entangled with pulp fibers and then creped, the creped fabric having at least one surface that contains peaks and valleys, wherein greater than about 90% of the peaks and less than about 10% of the valleys are applied with a treatment composition, the treatment composition comprising a crosslinked latex polymer, wherein the peaks define a user-contacting surface.

17. The textured composite fabric of claim 16, wherein approximately 100% of the peaks are applied with the treatment composition.

18. The textured composite fabric of claim 16, wherein approximately 0% of the valleys are applied with the treatment composition.

19. The textured composite fabric of claim 16, wherein the solids add-on level of the treatment composition is from about 0.5% to about 5%.

20. The textured composite fabric of claim 16, wherein the treatment composition further comprises a pigment.

21. The textured composite fabric of claim 16, wherein the pulp fibers comprise greater than about 50% by weight of the fabric.

22. The textured composite fabric of claim 16, wherein the pulp fibers comprise from about 60% to about 90% by weight of the fabric.

23. The textured composite fabric of claim 16, wherein the peaks define a user-contacting surface that is substantially uniformly coated with the treatment composition.

24. A textured composite fabric comprising a spunbond web hydraulically entangled with pulp fibers, the pulp fibers comprising greater than about 50% by weight of the fabric, the fabric having at least one surface that contains peaks and valleys, wherein greater than about 90% of the peaks and less than about 10% of the valleys are applied with a treatment composition, the treatment composition comprising a crosslinked latex polymer and a pigment, wherein the peaks define a user-contacting surface.

25. The textured composite fabric of claim 24, wherein approximately 100% of the peaks are applied with the treatment composition.

26. The textured composite fabric of claim 24, wherein approximately 0% of the valleys are applied with the treatment composition.

27. The textured composite fabric of claim 24, wherein the solids add-on level of the treatment composition is from about 0.5% to about 5%.

28. The textured composite fabric of claim 24, wherein the pulp fibers comprise from about 60% to about 90% by weight of the fabric.

29. The textured composite fabric of claim 24, wherein the peaks define a user-contacting surface that is substantially uniformly coated with the treatment composition.

* * * * *